US007755599B2

(12) United States Patent
Miyasaka

(10) Patent No.: US 7,755,599 B2
(45) Date of Patent: Jul. 13, 2010

(54) ELECTROPHORETIC DISPLAY DEVICE AND DRIVING METHOD THEREOF

(75) Inventor: Mitsutoshi Miyasaka, Suwa (JP)

(73) Assignee: Seiko Epson Corporation (JP)

( * ) Notice: Subject to any disclaimer, the term of this patent is extended or adjusted under 35 U.S.C. 154(b) by 910 days.

(21) Appl. No.: 11/330,305

(22) Filed: Jan. 11, 2006

(65) Prior Publication Data

US 2006/0209011 A1 Sep. 21, 2006

(30) Foreign Application Priority Data

Mar. 18, 2005 (JP) ..... 2005-079637

(51) Int. Cl.
*G09G 3/34* (2006.01)

(52) U.S. Cl. ..... 345/107; 345/105

(58) Field of Classification Search ..... 345/105, 345/107, 41

See application file for complete search history.

(56) References Cited

U.S. PATENT DOCUMENTS

| | | | | |
|---|---|---|---|---|
| 6,980,184 | B1 * | 12/2005 | Stewart et al. | 345/87 |
| 7,355,575 | B1 | 4/2008 | Ota et al. | |
| 2002/0021483 | A1 * | 2/2002 | Katase | 359/267 |
| 2002/0033792 | A1 * | 3/2002 | Inoue | 345/107 |
| 2004/0239614 | A1 * | 12/2004 | Amundson et al. | 345/107 |
| 2006/0072193 | A1 * | 4/2006 | Johnson | 359/430 |
| 2006/0170667 | A1 * | 8/2006 | Zhou et al. | 345/208 |
| 2007/0008278 | A1 * | 1/2007 | Johnson et al. | 345/107 |
| 2007/0206262 | A1 * | 9/2007 | Zhou | 359/267 |
| 2008/0150928 | A1 * | 6/2008 | Van Der Hoef et al. | 345/210 |

FOREIGN PATENT DOCUMENTS

| | | |
|---|---|---|
| JP | 06-265846 | 9/1994 |
| JP | 2003-222836 | 8/2003 |
| JP | 2004-094168 | 3/2004 |
| JP | 2004-157450 | 6/2004 |
| JP | 2004-252277 | 9/2004 |

* cited by examiner

*Primary Examiner*—Amr Awad
*Assistant Examiner*—John Morris
(74) *Attorney, Agent, or Firm*—Harness, Dickey & Pierce, P.L.C.

(57) ABSTRACT

An electrophoretic display device including a first substrate, a second substrate, an electrophoretic material interposed between the first substrate and the second substrate, the electrophoretic material including a positively charged particle and a negatively charged particle, a common electrode provided on the second substrate, a pixel provided at an intersection of a signal line and a scan line, the pixel provided in a plural number and arranged in matrix on the first substrate. The electrophoretic display device further including a pixel electrode provided in the pixel, a capacitor line provided in the pixel, a storage capacitor provided in the pixel, and a second electrode of the storage capacitor being coupled to a storage capacitor line and a thin film transistor (TFT) provided in the pixel, a source electrode of the TFT being coupled to a first electrode of the storage capacitor and the pixel electrode, a drain electrode of the TFT being coupled to the signal line, and a gate electrode of the TFT being coupled to the scan line. A capacitor line low select signal VSL or a capacitor line non-select signal VSC having a higher electric potential than an electric potential of the capacitor line low select signal VSL is supplied to the storage capacitor line.

13 Claims, 13 Drawing Sheets

PREVIOUS BLACK SCREEN-WHITE RESET-WHITE WRITING

PREVIOUS WHITE SCREEN-WHITE RESET-BLACK WRITING

PREVIOUS WHITE SCREEN-WHITE RESET-WHITE WRITING

PREVIOUS BLACK SCREEN-WHITE RESET-BLACK WRITING

PREVIOUS BLACK SCREEN-WHITE RESET-WHITE WRITING

PREVIOUS WHITE SCREEN-WHITE RESET-WHITE WRITING

ELECTROPHORETIC DISPLAY DEVICE AND DRIVING METHOD THEREOF

BACKGROUND OF THE INVENTION

1. Technical Field

The present invention relates to improve an electrophoretic display device.

2. Related Art

An electrophoretic display device has an element substrate on which a plurality of pixel electrodes are formed, an opposing substrate that is provided so as to oppose the element substrate, and an electrophoretic layer placed between these substrates. A common electrode is formed on a face of the opposing substrate opposing to the element substrate. The electrophoretic layer is made of a dispersion medium and more than one kind of charged electrophoretic particles dispersed in the dispersion medium.

JP-A-2004-94168 and JP-A-2004-157450 are examples of related art. As described in the examples, when an electric potential difference is given between the common electrode and the pixel electrode, the charged electrophoretic particle is drawn to either one of the electrodes depending on the direction of the electric field. When the electrophoretic particle is colored and the electrode is made of a transparent material, the color of the electrophoretic particle drawn to either the common electrode or the pixel electrode can be observed. Thereby, an image can be displayed by controlling the voltage applied to each pixel electrode.

When the image displayed by the electrophoretic display device is reset and a new image is formed, the reset is sometimes carried out insufficiently depending on the state of the displayed image before the reset, producing an afterimage which is persistence of a part of the image previously displayed. Furthermore, the contrast tends to be deteriorated when an image is retained by making the potential difference of 0 [V] between the common electrode and the pixel electrode after resetting the previous image with, for example, negatively charged white particles. This happens because the white particles start to diffuse when the image is retained and a white level turns to gray.

SUMMARY

An advantage of the invention is to provide an electrophoretic display device in which the persistence of the image and the contrast deterioration are prevented and improved and to provide a display method thereof.

According to first aspect of the invention, an electrophoretic display device includes a first substrate, a second substrate, an electrophoretic material interposed between the first substrate and the second substrate, the electrophoretic material including a positively charged particle and a negatively charged particle, a common electrode provided on the second substrate, a pixel provided at an intersection of a signal line and a scan line, the pixel provided in a plural number and arranged in matrix on the first substrate. The electrophoretic display device further includes a pixel electrode provided in the pixel, a capacitor line provided in the pixel, a storage capacitor provided in the pixel, and a second electrode of the storage capacitor being coupled to a storage capacitor line and a thin film transistor (TFT) provided in the pixel, a source electrode of the TFT being coupled to a first electrode of the storage capacitor and the pixel electrode, a drain electrode of the TFT being coupled to the signal line, and a gate electrode of the TFT being coupled to the scan line. A capacitor line low select signal VSL or a capacitor line non-select signal VSC having a higher electric potential than an electric potential of the capacitor line low select signal VSL is supplied to the storage capacitor line.

In this way, the electric field between the pixel electrode and the common electrode is externally set by controlling high and low (level) of the electric potential of the storage capacitor line. Accordingly, it is possible to prevent a luminance level shift and the contrast deterioration after the image data writing.

According to a second aspect of the invention, an electrophoretic display device includes a first substrate, a second substrate, an electrophoretic material interposed between the first substrate and the second substrate, the electrophoretic material including a positively charged particle and a negatively charged particle, a common electrode provided on the second substrate, a pixel provided at an intersection of a signal line and a scan line, the pixel provided in a plural number and arranged in matrix on the first substrate and a pixel electrode provided in the pixel. The electrophoretic display device further includes a capacitor line provided in the pixel, a storage capacitor provided in the pixel, and a second electrode of the storage capacitor being coupled to a storage capacitor line and a thin film transistor (TFT) provided in the pixel, a source electrode of the TFT being coupled to a first electrode of the storage capacitor and the pixel electrode, a drain electrode of the TFT being coupled to the signal line, and a gate electrode of the TFT being coupled to the scan line. A capacitor line high select signal VSH, a capacitor line non-select signal VSC or a capacitor line low select signal VSL is supplied to the storage capacitor line, the capacitor line high select signal VSH has a higher electric potential than an electric potential of the capacitor line non-select signal VSC; and the electric potential of the capacitor line non-select signal VSC is higher than an electric potential of the capacitor line low select signal VSL.

In this way, the electric field between the pixel electrode and the common electrode is externally set by controlling high and low (level) of the electric potential of the storage capacitor line. Accordingly, it is possible to secure the sufficient reset state and to prevent a luminance level shift and the contrast deterioration after the image data writing.

It is preferable that a common electrode high level signal Vcom-H is supplied to the common electrode in the case where a negatively charged particle reset in which the negatively charged particle is drawn to the second substrate side is performed, and a common electrode central level signal Vcom-C having a lower electric potential than an electric potential of the common electrode high level signal is supplied to the common electrode in other cases. It is also preferable that a capacitor line high select signal VSH is supplied to the storage capacitor line at the time of a negatively charged particle reset, and a capacitor line low select signal VSL is supplied to the storage capacitor line during a period in which an image signal is introduced into each pixel. In this way, the reset with the negatively charged particle is securely performed. Moreover, an image with a vivid color tone can be displayed after the reset.

It is preferable that a common electrode low level signal Vcom-L is supplied to the common electrode at the time of a positively charged particle reset in which the positively charged particle is drawn to the second substrate side, and a common electrode central level signal Vcom-C having a higher electric potential than an electric potential of the common electrode low level signal is supplied to the common electrode in other cases. In this way, the reset with the positively charged particle is securely performed. Moreover, an image with a vivid color tone can be displayed after the reset.

According to a third aspect of the invention, a driving method of an electrophoretic display device having an electrophoretic element having a common electrode, a pixel electrode and an electrophoretic material interposed between the electrodes and a storage capacitor whose one end is coupled to the pixel electrode includes a step of applying a reset voltage to the common electrode so as to display a first color tone, and applying a first electric potential to the other end of the storage capacitor, a step of removing the reset voltage from the common electrode and introducing a image signal to the pixel electrode so as to display a second color tone and applying a second electric potential to the other end of the storage capacitor, and a step of keeping the second color tone and applying a third electric potential to the other end of the storage capacitor, wherein the third electric potential has a value that is between the first electric potential and the second electric potential.

In this way, it is possible to promote the migration of the electrophoretic material, if the electrophoretic material migration is not sufficient because of the reset voltage that sets the electrophoretic element to a predetermined color tone. Furthermore, it is possible to prevent the electrophoretic material from diffusing after the migration finishes.

BRIEF DESCRIPTION OF THE DRAWINGS

The invention will be described with reference to the accompanying drawings, wherein like numbers reference like elements.

DESCRIPTION OF THE EMBODIMENTS

Embodiment of the invention is now described with reference to FIGS. 1 to 9.

Overall Configuration of Electrophoretic Display Device

Figure 1:
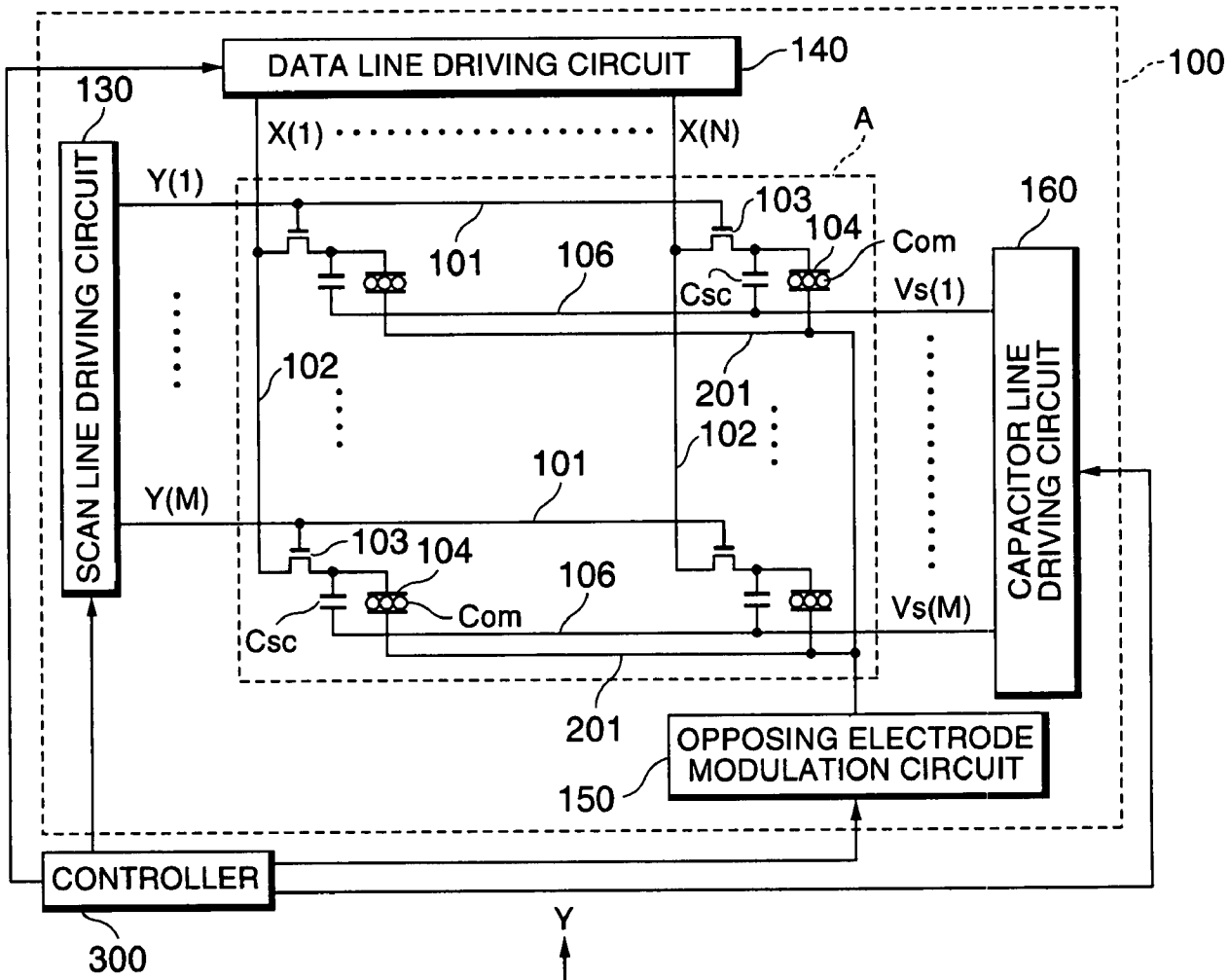
FIG. 1 is a block diagram for describing an overall configuration of an electrophoretic display device of the present invention.

Firstly, overall configuration of the device is described. FIG. 1 is a block diagram for describing an electric configuration of an electrophoretic display device. An electrophoretic display panel A and its peripheral region are provided on a surface of an element substrate 100. A scan line driving circuit 130, a data line driving circuit 140, an opposing electrode modulation circuit 150 and a capacitor line driving circuit 160 are provided in the periphery of the electrophoretic display panel A. The electrophoretic display panel A consists of a plurality of pixels.

The pixel includes a thin film transistor (TFT) 103 that serves as a switching element and a pixel electrode 104 coupled to the TFT 103 as shown in FIG. 2. The scan line driving circuit 130, the data line driving circuit 140, the opposing electrode modulation circuit 150 and the capacitor line driving circuit 160 are formed in a peripheral region of the element substrate 100.

A controller 300 is provided in a peripheral circuit of the electrophoretic display device. The controller 300 includes an unshown image signal processing circuit and an unshown timing generator. The image signal processing circuit generates an image data, an opposing electrode control signal and a capacitor line driving circuit control signal according to resetting and image writing and the like. The image signal processing circuit then correspondingly outputs these data and signals to the data line driving circuit 140, the opposing electrode modulation circuit 150 and the capacitor line driving circuit 160. The timing generator generates various kinds of timing signals in order to control the scan line driving circuit 130 and the data line driving circuit 140 at the time of reset setting and when the image data is outputted from the image signal processing circuit.

As described above, the reset is performed in order to draw the electrophoretic particle moving in the dispersion medium towards the pixel electrode 104 and a common electrode 201, and to initialize a spatial state. The reset is carried out in a predetermined period before an image data is written into the pixel.

The opposing electrode modulation circuit 150 supplies a common electrode bias signal Vcom to a common electrode Com.

The capacitor line driving circuit 160 supplies a storage capacitor bias signal Vs to a storage capacitor Csc. Holding conditions after the reset or writing of the image depends on bias voltages such as the common electrode bias signal Vcom and the storage capacitor bias signal Vs, which is hereinafter described.

A scan line 101 is provided in the plural number in the electrophoretic display panel A on the element substrate 100. The scan lines are formed in parallel and along X direction shown in the figure. A data line 102 is also provided in the plural number along Y direction that is orthogonal to the X direction as shown in the figure. These data line are formed in parallel in the Y direction. Each pixel is provided corresponding to an intersection of the scan line 101 and the data line 102 so that the pixels are arranged in matrix.

Pixel Structure

Figure 2A:
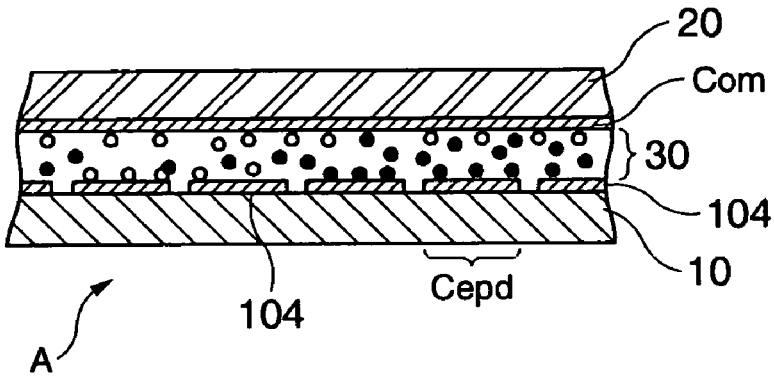
FIG. 2 is a circuit diagram for describing a configuration example of a pixel circuit in the electrophoretic display device according to an embodiment of the invention.
Figure 2B:
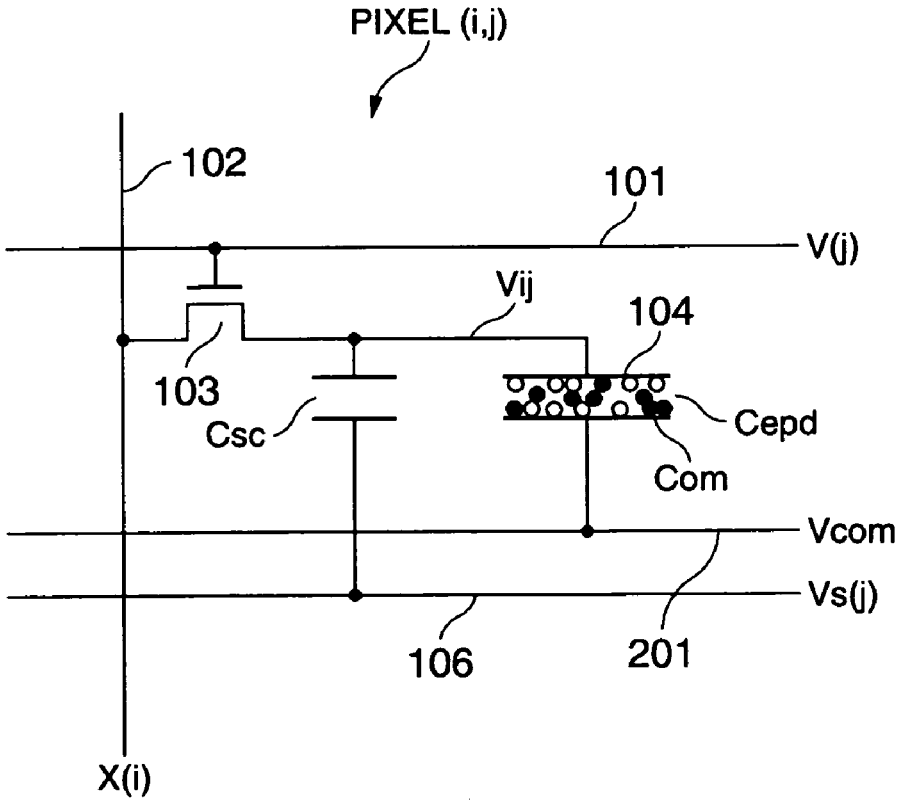

FIG. 2 shows a structure of the above-mentioned pixel. FIG. 2A is a sectional view of the pixel part of the electrophoretic display panel. FIG. 2B shows an electric circuit of the pixel.

As shown in FIG. 2A, the electrophoretic display panel has the plurality of the pixel electrodes 104 formed in matrix on a first substrate 10, the transparent common electrode Com formed on a second substrate 20 and an electrophoretic layer 30 interposed therebetween. The electrophoretic layer 30 includes more than one kind of charged particle (microparticle) and a dispersion medium that makes the charged particles movable. Pixel capacitance Cepd of each pixel depends on an area of the pixel electrode 104 (an area where the pixel electrode 104 overlaps the common electrode Com), a distance between the electrodes and the permittivity of the electrophoretic layer 30. Though not shown in the figure, the storage capacitor Csc that holds the information (electric charge) of the image for a certain period is provided in parallel with the pixel capacitance Cepd.

As shown in FIG. 2B, the pixel (i,j) that is placed at the intersection of the $i^{th}$ row and the $j^{th}$ column includes the TFT 103, the pixel electrode 104 and the storage capacitor Csc. A gate terminal of the TFT 103 is coupled to the scan line 101 and a source terminal of the TFT 103 is coupled to the data line 102. Furthermore, a drain terminal of the TFT 103 is coupled to the pixel electrode 104 and the storage capacitor Csc.

Each pixel has the electrophoretic layer 30 interposed between the pixel electrode 104 and the common electrode Com, thereby, the pixel capacitance Cepd that depends on the area of the electrode, the distance between the electrodes and the permittivity of the electrophoretic layer 30 is formed. The common electrode Com is coupled to the opposing electrode modulation circuit 150 through the wiring 201. The other end of the storage capacitor Csc is coupled to a storage capacitor line 106 and the storage capacitor line 106 is coupled to the capacitor line driving circuit 160.

When a scan line select signal Y (j) in the $j^{th}$ row becomes active in such electrophoretic display panel A, the TFTs 103 coupled to the $j^{th}$ scan line 101 in the $j^{th}$ row turn into ON state. If data signals X1, X2, . . . Xi, . . . Xn are supplied from the data line driving circuit in this state, luminance levels corresponding to the data signals X1, X2, . . . Xi, . . . Xn are provided to the corresponding pixel electrodes 104 in the $j^{th}$ row that are coupled to the $j^{th}$ scan line 101 through the TFTs 103.

The common electrode bias signal Vcom which is an opposing voltage is supplied to the common electrode Com on an opposing substrate 200 from the opposing electrode modulation circuit 150. The storage capacitor bias signal Vs is supplied to the storage capacitor Csc from the capacitor line driving circuit 160. A pixel electrode voltage (or electric potential) Vij can be pushed up or down by applying the bias voltage Vs to the storage capacitor Csc, which is hereinafter described in detail. In this way, the potential difference between the pixel electrode 104 and the common electrode Com or the pixel electrode voltage Vij is controlled. The electrophoretic particles in the electrophoretic layer 30 moves according to the electric field between the electrodes. This forms a gray scale depending on the reset and the image data signal X or a pixel (image) corresponding to a binary level.

Operation Mechanism

Next, the operation mechanism in the invention is described with reference to FIG. 2 and FIG. 3. The invention controls the bias voltage applied to the storage capacitor according to an operation mode of the image display. Thereby, the voltage difference (electric field intensity) between the pixel electrode and the common electrode can be appropriately set, suppressing the diffusion migration of the charged particle or promoting the movement of the charged particle. Consequently, it is possible to prevent the contrast deterioration and the image persistence from occurring.

The pixel (i,j) that is placed at the intersection of the $i^{th}$ row and the $j^{th}$ column includes the TFT 103, the pixel electrode 104 and the storage capacitor Csc as described above. The gate terminal of the TFT 103 is coupled to the scan line 101 that transfers the scan line select signal Y (j) from the scan line driving circuit. The source terminal of the TFT 103 is coupled to the data line 102 that transfers the data signal X (j) from the data line driving circuit. Furthermore, the drain terminal of the TFT 103 is coupled to the pixel electrode 104 and the storage capacitor Csc. The common electrode Com is coupled to the wiring 201 through which the common electrode bias signal Vcom is transmitted from the hereinafter described opposing electrode modulation circuit. The other end of the storage capacitor Csc is coupled to the storage capacitor line 106 through which a storage capacitor line bias signal Vs (j) is transmitted from the capacitor line driving circuit (see FIG. 2B).

Figure 3B:
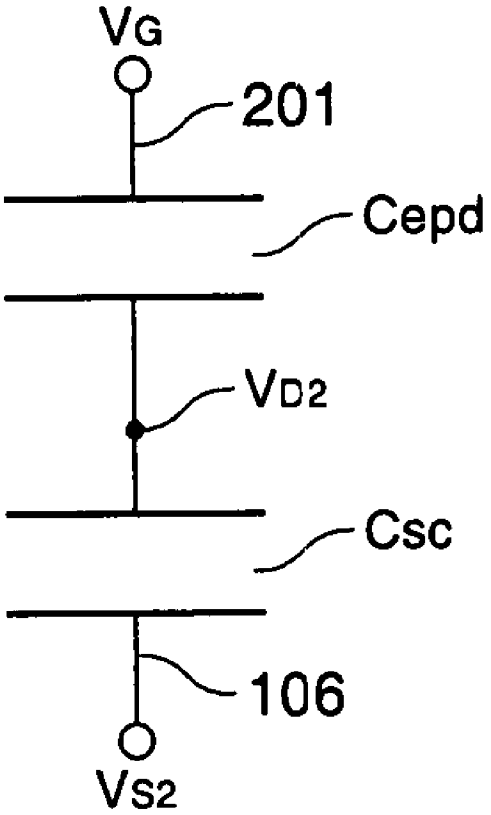
FIG. 3 is an explanatory drawing for bias voltage application by making use of a storage capacitor.
Figure 3A:
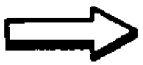
Figure 3A:
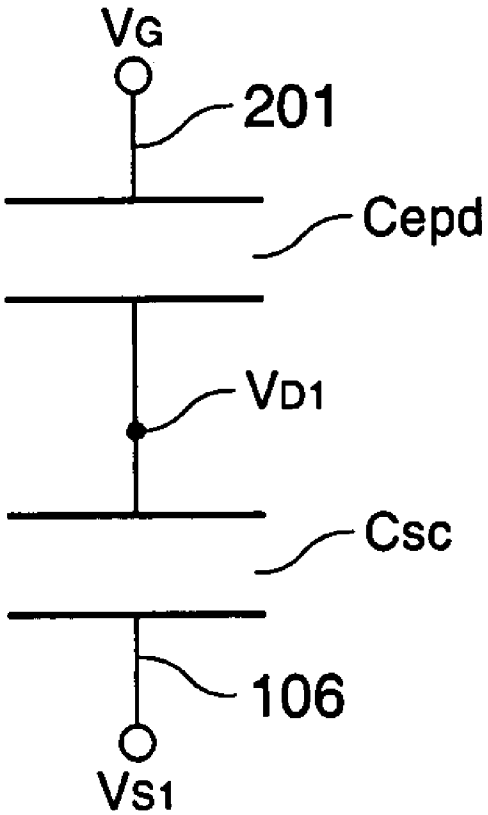

FIG. 3 is an equivalent circuit diagram of the pixel circuit for describing a push-up operation of the pixel electrode voltage Vij (=VD) by applying the bias voltage signal to the storage capacitor Csc in the above mentioned pixel circuit.

FIG. 3A shows the equivalent circuit at the time when the image signal or the data is introduced into each pixel. The voltage Vs1 is applied to the storage capacitor line 106, the voltage VD1 is applied to the pixel electrode and the voltage VG is applied to the common electrode in this state. On the other hand, FIG. 3B shows the equivalent circuit at the time when the data is stored. The voltage Vs2 is applied to the storage capacitor line 106, the voltage VD2 is applied to the pixel electrode and the voltage VG is applied to the common electrode in this state. The pixel electrode voltage is related to the increase in the bias voltage Vs of the storage capacitor Csc by the following formula.

According to the law of conservation of electric charge, $$(VD1-VG)Cepd=(Vs1-VD1) \quad \text{formula (1)}$$

$$(VD2-VG)Cepd=(Vs2-VD2) \quad \text{formula (2)}$$

$$\text{then, } VD2=VD1+[Csc/(Cepd+Csc)]\cdot(Vs2-Vs1)$$

$$\text{here, } VD2=VD1+\alpha\cdot(Vs2-Vs1) \quad \text{formula (3)}$$

$$\text{where } \alpha=Csc/(Cepd+Csc) \text{ with } 0<\alpha<1.$$

Generally, Csc>>Cepd and Csc>10 Cepd. When Csc=10 Cepd, $\alpha$=0.91 and the formula (3) becomes, $$VD2=VD1+0.91\cdot(Vs2-Vs1).$$

Thus, the voltage VD of the pixel electrode can be set by the variation in the storage capacitor bias voltage $\Delta$Vs (=Vs2−Vs1).

The electric potential difference between the pixel electrode potential Vij and the common electrode potential Vcom forms the electric field that retains the charged particles on the electrodes. Therefore, a condition to hold the charged particle on the electrodes can be derived from the formula (3). For example, the condition to hold the negatively charged particle at the time of the reset of the negatively charged particle is, Vcom-C>VL+$\alpha$·(VSC−VSL), where VL is a white level (in case of a white reset) of the image data, VSC is an central level of the capacitor line bias signal and VSL is a low level of the capacitor line bias signal that is lower than the level VSC.

The condition to hold the negatively charged particle at the time of the reset of the negatively charged particle is also written as, Vcom-C<VH+α·(VSC−VSH), where VH is a black level (in case of a black reset) of the image data, and VSH is a high level of the capacitor line bias signal that is higher than the central level VSC of the capacitor line bias signal.

An example of controlling the image display by setting such storage capacitor bias voltage is now described.

Example of Basic Control Operation

Writing operation in a pixel (i, j) (see FIG. 2) is described with reference to FIG. 4 and FIG. 6.

Figure 4:
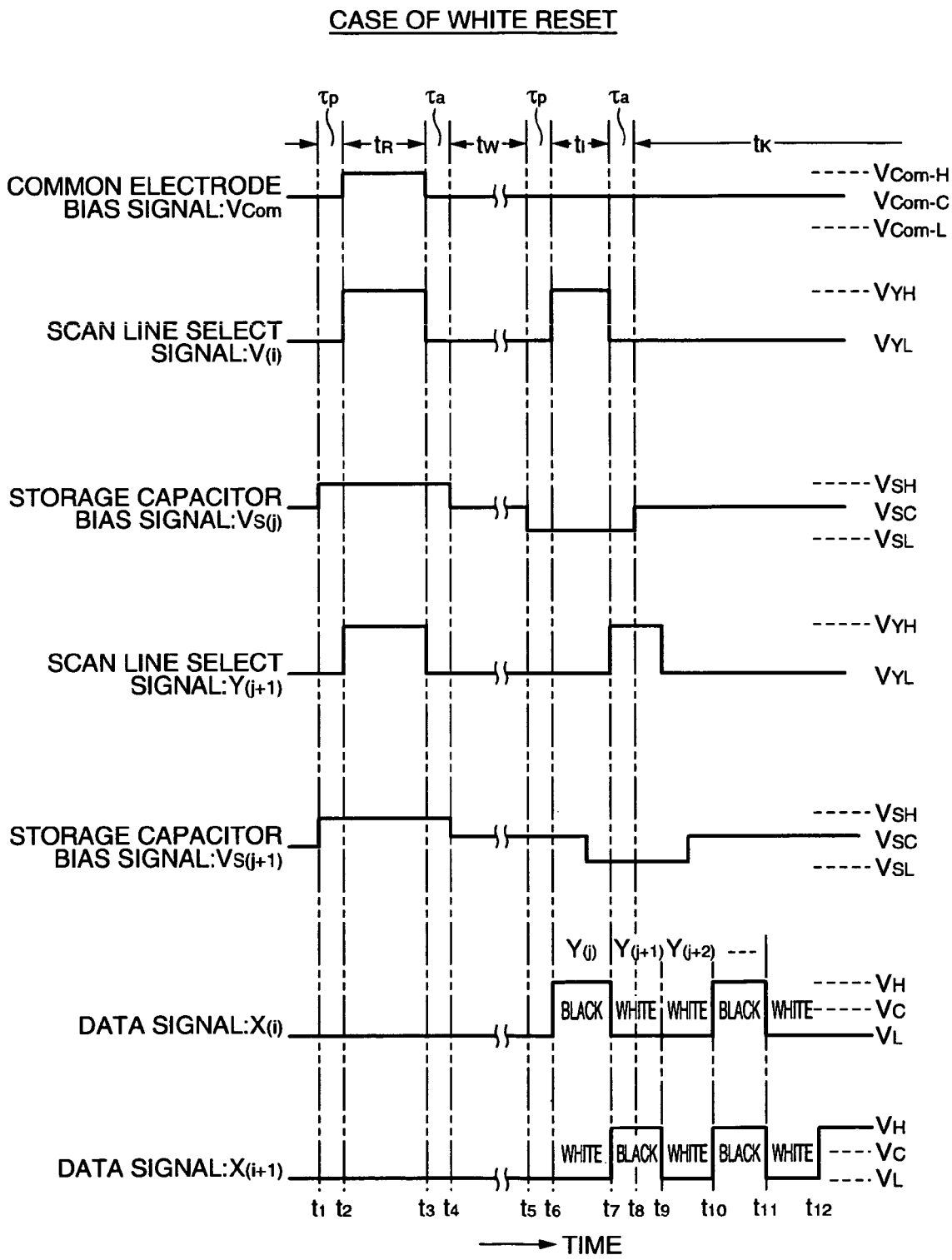
FIG. 4 is a signal timing chart for describing operation of a negatively-charged particle reset.

FIG. 4 is a timing chart for describing a control operation example in which the storage capacitor bias voltage is variable in the electrophoretic display device according to the embodiment. FIG. 6 is an explanatory drawing for describing the state of the electrophoretic particles in each operation mode.

In the embodiment, the image (pixel) data is written after the reset of the negatively charged particle. The image data writing (image display) consists of a sequence of operation modes in time axis.

At an initial state, the above-mentioned common electrode bias signal Vcom is at the central level Vcom-C (common electrode central level signal), the scan line select signal Y (j) is at a low level VYL, the storage capacitor bias signal Vs (j) is at the central level VSC (capacitor line non-select signal) and the data signal X (j) is at the white level (VL) as shown in FIG. 4.

The storage capacitor bias signal rises from the central level VSC to the high level VSH (capacitor line high select signal) at a time t1 and remains in the high level till a time t4. In this way, the storage capacitor Csc is charged.

The common electrode bias signal Vcom rises to a high level Vcom-H (common electrode high level signal) at a time t2 and retains the high level Vcom-H till a time t3. The TFT 103 becomes conductive by a high level VYH of the scan line select signal Y (j), setting the potential Vij of the $j^{th}$ row pixel electrode at the low level VL (white level). At the same time, the common electrode potential Vcom is set to the high level Vcom-H.

Consequently, the potential difference between the pixel electrode and the common electrode becomes Vcom-H−VL and the negatively charged particle is drawn to the common electrode. On the other hand, the positively charged particle is drawn to the pixel electrode. The same procedure is carried out in every pixel and the reset by the negatively charged particle is conducted.

Figures 6A, 6B, 6C, 6D, 6E:
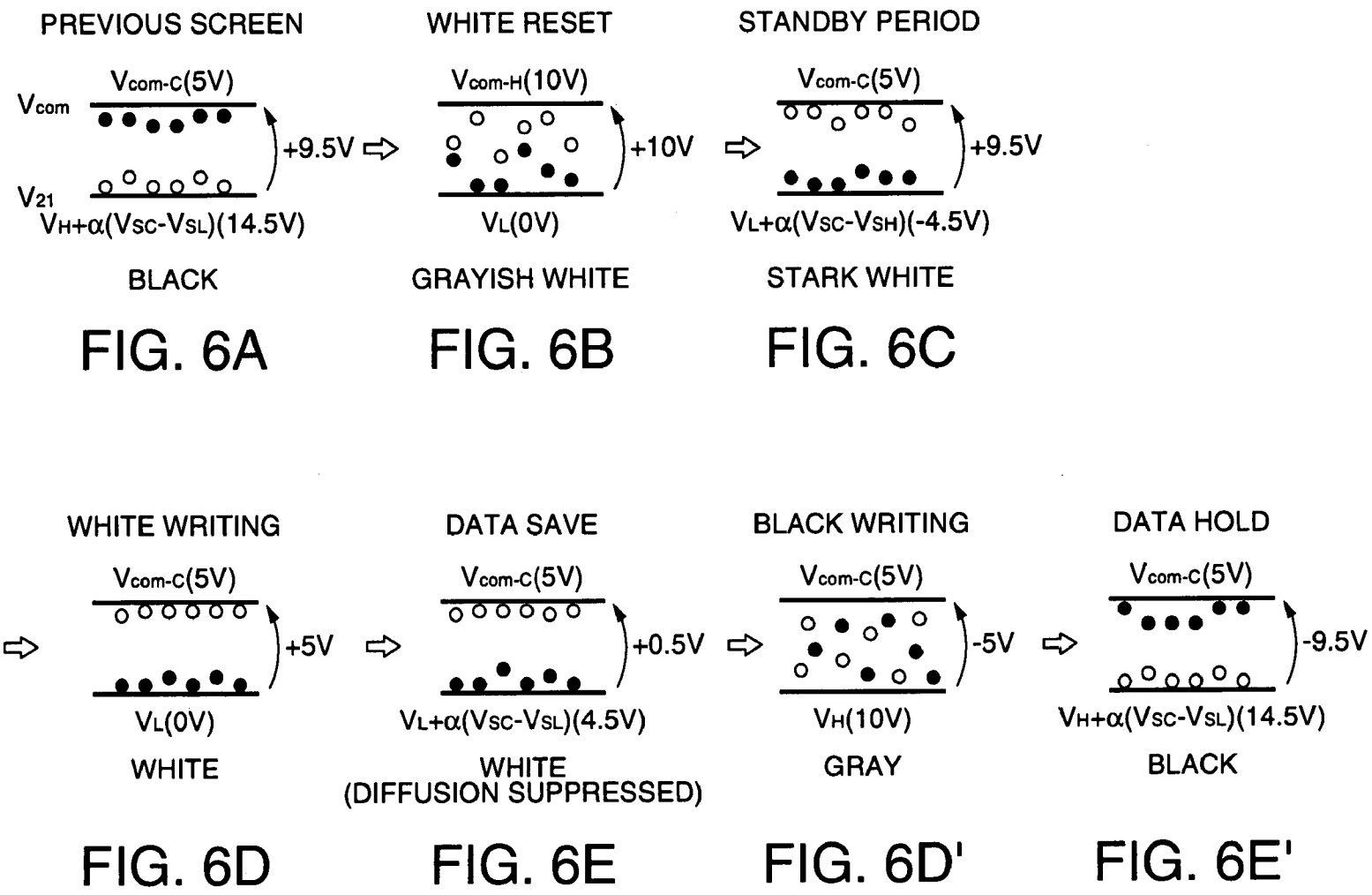
FIG. 6 is an explanatory drawing for white writing (previous screen is black) after the negatively-charged particle reset.
Figure 7A:
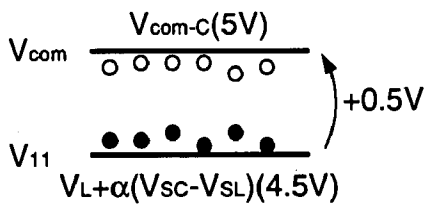
FIG. 7 is an explanatory drawing for black writing (previous screen is white) after the negatively-charged particle reset.
Figure 7B:
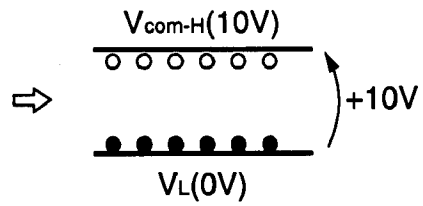
Figure 7C:
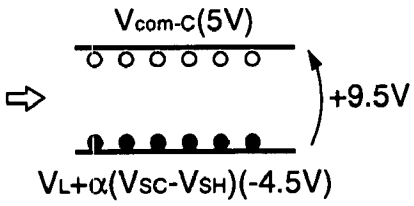
Figure 7D:
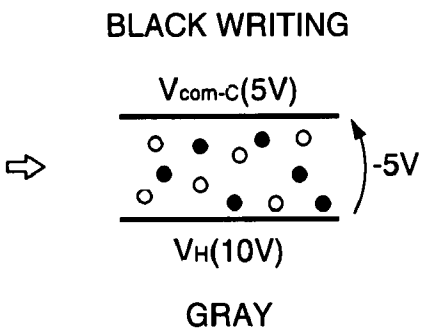
Figure 7E:
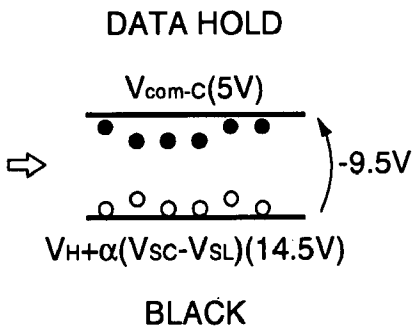

In the reset state, when the negatively charged particle is white and the positively charged particle is black, the negatively charged particles are gathered on the common electrode side and the whole screen becomes white as shown in FIG. 6B. If the previous screen is black, the positively or negatively charged particles will not completely return (move) to the electrodes and the screen becomes grayish white as shown in FIG. 6A.

The common electrode bias signal Vcom drops to the central level Vcom-C and the scan line select signal Y(j) falls to the low level VYL at the time t3, making the TFT 103 non-conductive. Accordingly, the potential difference between the pixel electrode and the common electrode decreases to Vcom-C−VL. However, this value is positive so that the reset state by the negatively charged particle is further enhanced.

The storage capacitor bias signal Vs (j) drops from the high level VSH to the central level VSC at the time t4 and remains at the central level till a time t5. Accordingly, the pixel electric potential Vij becomes VL+α(VSC−VSH), this forms substantially the same bias electric field as that of the reset state between the electrode during the period from the time t4 to the time t5.

In this standby status (the time t4-t5), the negatively charged particle is drawn to the common electrode Com side and the positively charged particle is drawn to the pixel electrode 104 side. Therefore, in case where the negatively charged particle is white, the screen becomes further whiter. Even if the screen is grayish white in the reset state, the screen still becomes white. If the negatively charged particle is black, the black screen then becomes further blacker.

The storage capacitor bias signal Vs (j) falls from the central level VSC to the low level VSL (capacitor line low select signal) at the time t5, changing the electric charge stored in the storage capacitor.

The scan line select signal Y (j) rises to the high level VYH in a time t6-t7 and the TFT 103 becomes conductive. At the same time, the data signal X (j) becomes the black level (VH). Accordingly, the black writing is performed by the difference VH−Vcom-C between the potential of the pixel electrode 104 and the common electrode potential Vcom.

In the writing state (the time t6-t7), when the black writing is carried out after the negative charge reset (see FIG. 6C), it is difficult to obtain the stark black tone and the screen becomes gray as shown in FIG. 6D'.

The storage capacitor bias signal Vs (j) rises to the central level VSC at a time t8. In this sate, the pixel electric potential Vij becomes VH+α(VSC−VSL). The potential difference Vcom-C−[VH+α(VSC−VSL)], which is the difference between the common electrode potential Vcom and the pixel potential VH+α(VSC−VSL) applied at the pixel, and therefore, the black of the screen is enhanced as shown in FIG. E'. In this way, the contrast is improved. This operation mode continues till the next reset operation and the status becomes a data hold state (image display state).

In a case where the pixel data (see the data signal X(i+1) shown in FIG. 4) is white (VL) in the above-described writing operation (the time t6-t7), a white writing is conducted as shown in FIG. 6D. The pixel electric potential Vij becomes VL+α(VSC−VSL) in the above-mentioned data hold state. The weak bias electric field is formed between the electrodes by the potential difference Vcom-C−[VL+α(VSC−VSL)], which is the difference between the common electrode potential Vcom and the pixel potential VL+α(VSC−VSL), and this suppresses the diffusion of the charged particles. In the case shown in the figure, the diffusion of the negatively charged particle is inhibited, and this prevents the image contrast from being deteriorated.

A period τp (the time t1-t2) is a time margin in consideration of the rising edge of the storage capacitor bias signal (period of the capacitor charge), and a period τa (the time t3-t4) is a time margin in consideration of the trailing edge of the storage capacitor bias signal (period of the capacitor discharge).

As described above, the storage capacitor bias signal Vs (j) is changed from the high level VSH to the central level VSC during a standby period tW which is the time t4-t5 after the reset, and this generates the bias electric field that promotes the reset between the electrodes. During a data hold period after the data writing and the time t8, the storage capacitor bias signal Vs (j) is changed from the low level VSL to the central level VSC. This either prevents the charged particles from diffusing between the electrodes or promotes the charged particles to move toward the electrode.

Parameter Setting and so on.

Though the negatively charged electrophoretic particle is white and the positively charged electrophoretic particle is black in the explanatory drawings of the embodiment, the negatively charged particle may be black and the positively charged particle may be white.

As described above, the data signal X (i) that provides the luminance data of the pixel includes the high (black) level VH, the central (grey) level VC and the low (white) level VL. The central level VC is not particularly limited but may be set as, for example, VC=(VH+VL)/2 (the central potential).

In this embodiment, the above-mentioned common electrode bias signal Vcom has the three voltage levels such as the high level Vcom-H, the central level Vcom-C and the low level Vcom-L (Vcom-H>Vcom-C>Vcom-L). For example, the central level Vcom-C can be set as Vcom-C=(Vcom-H+Vcom-L)/2 (though not limited to this value).

The configuration of the power supply may be simplified by utilizing the voltage levels VH, VC and VL of the power supply of the circuit that provides the voltage levels of the above-mentioned data signal for making the levels Vcom-H, Vcom-C and Vcom-L of the common electrode bias signal Vcom.

The above-described scan line select signal Y (j) includes the high level VYH and the low level VYL (VYH>VYL). The level VYH is the voltage level that switches the TFT 103 on and VYH≧VH. The level VYL is the voltage level that switches the TFT 103 off and VL≧VYH.

The configuration of the power supply may be simplified by utilizing the voltage levels VH and VL of the circuit power supply for making the levels VYH and VYL.

The storage capacitor bias signal Vs (j) includes the high level VSH, the central level VSC and the low level VSL (VSH>VSC>VSL). For example, the central level VSC may be set as VSC=(VSH+VSL)/2 (though not limited to this value).

The power supply for the levels VYH and VYL of the scan line select signal may also be used for providing the high level VSH and the low level VSL of the storage capacitor bias signal. Moreover, the levels VH, VC and VL of the data signal may be used correspondingly for the high level VSH, the central level VSC and the low level VSL of the storage capacitor bias signal in order to simplify the power source configuration.

The following signal setting is carried out in the above-described image display operation.

As a condition of the negatively charged particle reset, the high level Vcom-H of the common electrode bias signal is set to be higher than the low (white) level VL of the data signal (Vcom-H>VL).

As a condition of the positively charged particle reset, the low level Vcom-L of the common electrode bias signal is set to be lower than the high (black) level VH of the data signal (Vcom-L<VH).

A white state retention condition at the time of the negatively charged particle reset can be derived from the formula (3). That is Vcom-C>VL+α(VSC−VSL).

A black state retention condition at the time of the positively charged particle reset is that Vcom-C<VH+α·(VSC−VSH).

A condition of the white display is to set Vcom-C>VL and a condition of a black display is to set Vcom-C<VH.

Specific Example of Control Operation

The sequence of the operation modes that composes the above described image display is now described in detail with reference to various writing patterns.

I. Case of Image Data Writing After Negatively Charged Particle Reset

The case of the image data writing after the negatively charged particle reset is described with reference to FIG. 4 and FIG. 6. In this case, the negatively charged particle is the white colored particle and the positively charged particle is the black colored particle.

1. Operation of Negatively Charged Particle Reset (Period tR)

The common electrode bias signal in a period tR is denoted as Vcom (tR). Accordingly, the common electrode bias signal is set as Vcom (tR)=Vcom-H.

The pixel voltage of the pixel (i, j) in the period tR is denoted as Vij (tR). Accordingly, the pixel voltage of the pixel (i, j) becomes Vij (tR)=VL because the level VL of the data signal is provided to the pixel electrode when the TFT 103 becomes conductive with the high level VYH of the scan line select signal. In this state, the electric field of an electrophoretic element is Vcom−Vij (tR)=Vcom-H−VL>0, and the negatively charged particle is drawn to the common electrode Com side and the positively charged particle is gathered on the pixel electrode side. Consequently, the screen becomes the white display as shown in FIG. 6B.

For example, when Vcom-H=VH=10 [V] and VL=0 [V], Vcom−Vij (tR)=10 [V]−0 [V]=10 [V]. Therefore, the white particle is drawn to the common electrode Com side.

2. Standby Operation (Period tW)

The common electrode bias signal in a period tW is denoted as Vcom (tW). Accordingly, the common electrode bias signal is set as Vcom (tW)=Vcom-C.

Since the TFT 103 is non-conductive in this state, a pixel voltage Vij (tW) of the pixel (i, j) in the period tW is set as follows:

$$\begin{aligned} Vij(tW) &= Vij(tR) + a\cdot(Vs(tW) - Vs(tR)) \\ &= VL + a\cdot(VSC - VSH) \end{aligned}$$

Accordingly, the electric filed of the electrophoretic element becomes Vcom (tW)−Vij (tW)=Vcom-C−[VL−α·(VSC−VSH)]>Vcom-C−VL. Therefore, the screen becomes the white display.

For example, when Vcom-C=VSC=VC=5 [V] and VSH=VH=10 [V], Vcom (tW)−Vij (tW)=9.5 [V].

As shown in FIG. 6B, the potential difference of 9.5 [V] is secured even in the standby period so that the screen credibly displays white. Furthermore, this makes it possible to shorten the reset period.

3. White Writing Operation (Period tI)

The common electrode bias signal in a writing period tI is denoted as Vcom (tI). Accordingly, the common electrode bias signal is set as Vcom (tI)=Vcom-C. The pixel voltage of the pixel (i, j) in the period tI becomes Vij (tI)=VL because the TFT 103 is conductive in this state.

The electric field of the electrophoretic element is Vcom (tI)−Vij (tI)=Vcom-C−VL>0. Consequently, the screen becomes the white display.

For example, when Vcom (tI)=5 [V] and Vij (tI)=0 [V], Vcom (tI)−Vij (tI)=5−0=5 [V]>0. The white particle is kept being drawn to the upper common electrode Com so that the white level of the white display is improved as shown in FIG. 6D. Consequently, the white contrast is improved and the persistence of the image is eliminated.

4. Data Hold Operation After White Writing (Period tK)

The common electrode bias signal in a data hold period tK is denoted as Vcom (tK). Accordingly, the common electrode bias signal is set as Vcom (tK)=Vcom-C. Since the TFT 103 is non-conductive in this state, the pixel voltage of the pixel (i, j) in the period tK becomes as follows:

$$Vij(tK) = Vij(tI) + a \cdot (Vs(tK) - Vs(tI))$$
$$= VL + a \cdot (VSC - VSL)$$

Accordingly, the electric filed of the electrophoretic element becomes Vcom (tK)−Vij (tK)=Vcom-C−VL+α·(VSC−VSL)>0. Therefore, the screen becomes the white display.

For example, when Vcom (tK)=5 [V], VL=0 [V], VSC=5 [V] and VSL=0 [V], Vcom (tK)−Vij (tK)=5−4.5=0.5 [V]>0.

This means that the small electric potential remains even in the data hold period and it works to prevent the white particle from diffusing as shown in FIG. 6E.

The white particle is kept being drawn to the upper common electrode Com so that the white level of the white display is improved. Consequently, the white contrast is improved and the persistence of the image is eliminated.

5. Black Writing Operation (Period tI)

Following the above-described negatively charged particle reset I-(1) and the standby period I-(2), black writing is performed as shown in FIG. 6D'. In this case, the common electrode bias signal in the writing period tI is denoted as Vcom (tI). Accordingly, the common electrode bias signal is set as Vcom (tI)=Vcom-C. Since the TFT 103 is conductive in this state, the pixel voltage of the pixel (i, j) in the period tI is set as Vij (tI)=VH.

The electric filed of the electrophoretic element becomes Vcom (tI)−Vij (tI)=Vcom-C−VH<0. Therefore, the screen becomes the black display.

For example, when Vcom (tI)=5 [V] and Vij (ti)=10 [V], Vcom (tI)−Vij (tI)=5−10=−5 [V]>0. The white particle is kept being drawn to the upper common electrode Com during this period so that the white level of the white display is improved. Consequently, the white contrast is improved and the persistence of the image is eliminated.

6. Data Hold After Black Writing (Period tK)

The common electrode bias signal Vcom (tK) in the data hold period tK is set as Vcom (tK)=Vcom-C. Since the TFT 103 is non-conductive in this state, the pixel voltage Vij (tK) becomes as follows:

$$Vij(tK) = Vij(tI) + a \cdot (Vs(tK) - Vs(tI))$$
$$= VH + a \cdot (VSC - VSL)$$

Accordingly, the electric filed of the electrophoretic element becomes Vcom (tK)−Vij (tK)=Vcom-C−VH−α·(VSC−VSL)<0. Therefore, the screen becomes the black display as shown in FIG. 6E'.

For example, when Vcom (tK)=5 [V], VH=10 [V], VSC=5 [V] and VSL=0 [V], Vcom (tK)−Vij (tK)=5−10−4.5 [V]=−9.5 [V]<0.

This means that the small electric potential remains even during the data hold period and it works to prevent the white particle from diffusing.

The black particle is kept being drawn to the upper common electrode Com so that the black level of the black display is improved.

II. Case of Image Data Writing After Positively Charged Particle Reset

Figure 5:
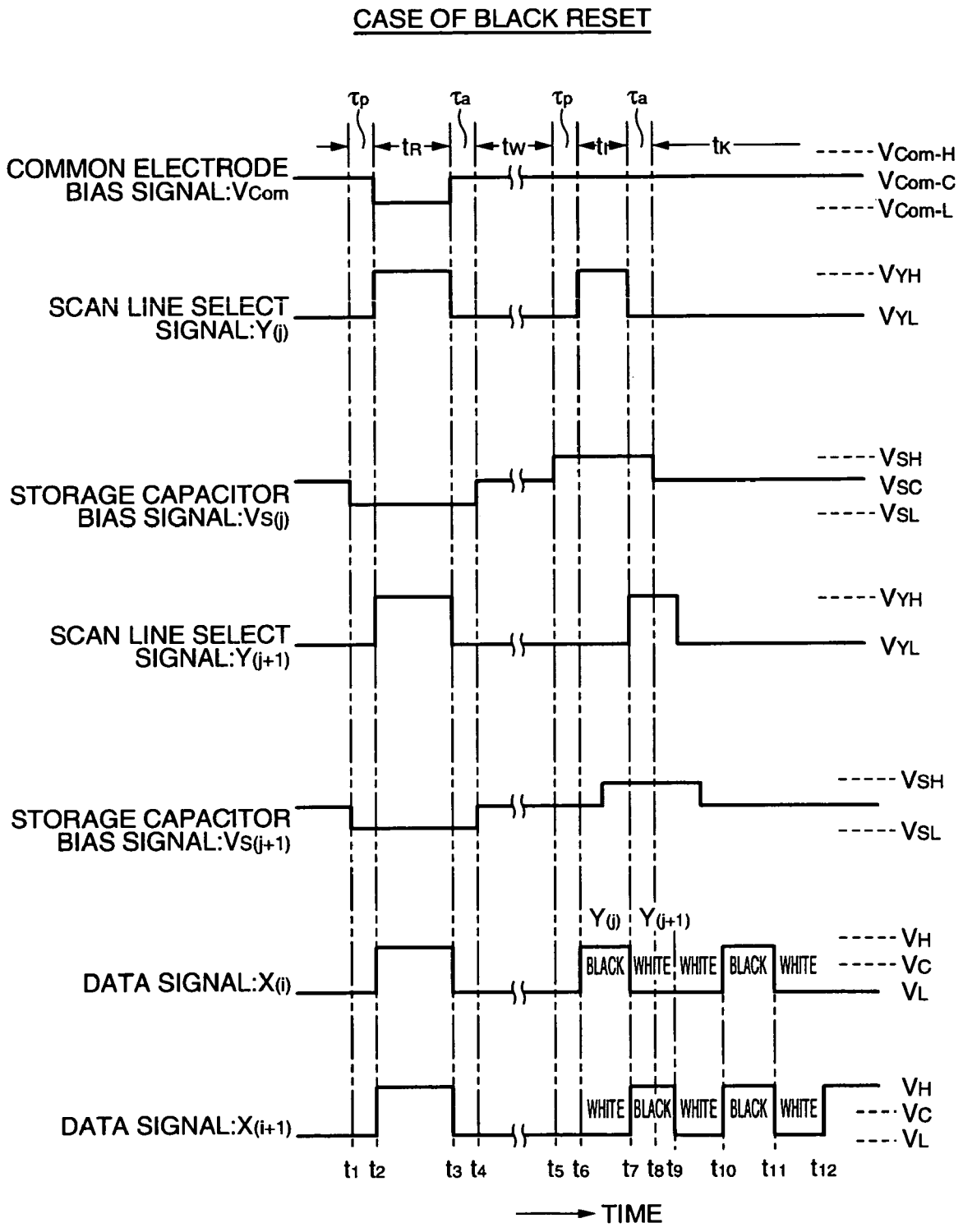
FIG. 5 is a signal timing chart for describing operation of a positively-charged particle reset.

FIG. 5 is a signal timing chart for describing the writing operation after a positively-charged particle reset. In FIG. 5, the same reference numerals are given to the corresponding components to those in FIG. 4. As described above, the negatively charged particle is the white colored particle and the positively charged particle is the black colored particle.

1. Positively Charged Particle Reset (Period tR)

The common electrode bias signal in the period tR is denoted as Vcom (tR). Accordingly, the common electrode bias signal is set as Vcom (tR)=Vcom-H.

The pixel voltage of the pixel (i, j) in the period tR is denoted as Vij (tR). Accordingly, the pixel voltage of the pixel (i, j) becomes Vij (tR)=VH because the level VH of the data signal X (i) is provided to the pixel electrode when the TFT 103 becomes conductive with the high level VYH of the scan line select signal. In this state, the electric field of the electrophoretic element is Vcom−Vij (tR)=Vcom-L−VH<0. Consequently, the screen becomes the black display.

For example, when Vcom-L=VL=0 [V] and VH=10 [V], Vcom−Vij (tR)=0 [V]−10 [V]=−10 [V]. Therefore, the black particle is drawn to the common electrode Com side.

2. Standby Operation (Period tW)

The common electrode bias signal in the period tW is denoted as Vcom (tW). Accordingly, the common electrode bias signal is set as Vcom (tW)=Vcom-C.

Since the TFT 103 is non-conductive in this state, the pixel voltage Vij (tW) of the pixel (i, j) in the period tW is set as follows:

$$Vij(tW) = Vij(tR) + a \cdot (Vs(tW) - Vs(tR))$$
$$= VH + a \cdot (VSC - VSL)$$

Accordingly, the electric filed of the electrophoretic element becomes Vcom (tW)−Vij (tW)=Vcom-C−[VH−α·(VSC−VSL)]<Vcom-C−VH. Therefore, the screen becomes the black display.

For example, when Vcom-C=VSC=VC=5 [V] and VSH=VH=10 [V], Vcom (tW)−Vij (tW)=−9.5 [V].

The potential difference of −9.5 [V] is secured even during the standby period so that the screen credibly displays black. Furthermore, this makes it possible to shorten the reset period.

3. White Writing Operation (Period tI)

The common electrode bias signal in the writing period tI is denoted as Vcom (tI). Accordingly, the common electrode bias signal is set as Vcom (tI)=Vcom-C. The pixel voltage of the pixel (i, j) in the period tI becomes Vij (tI)=VH because the TFT 103 is conductive in this state.

The electric field of the electrophoretic element is Vcom (tI)−Vij (tI)=Vcom-C−VH<0. Consequently, the screen becomes the black display.

For example, when Vcom (tI)=5 [V] and Vij (tI)=10 [V], Vcom (tI)−Vij (tI)=5−10=−5 [V]>0. The black particle is kept being drawn to the upper common electrode Com so that the black level of the black display is improved. Consequently, the black contrast is improved and the persistence of the image is eliminated.

4. Data Hold After Black Writing (Period tK)

The common electrode bias signal in the data hold period tK is denoted as Vcom (tK). Accordingly, the common electrode bias signal is set as Vcom (tK)=Vcom-C. Since the TFT 103 is non-conductive in this state, the pixel voltage Vij (tK) of the pixel (i, j) in the period tK becomes as follows:

$$Vij(tK) = Vij(tI) + a \cdot (Vs(tK) - Vs(tI))$$
$$= VH + a \cdot (VSC - VSH)$$

Accordingly, the electric filed of the electrophoretic element becomes Vcom (tK)−Vij (tK)=Vcom-C−VH+α·(VSC−VSH)<0. Therefore, the screen becomes the black display.

For example, when Vcom (tK)=5 [V], VH=10 [V], VSC=5 [V] and VSH=10 [V], Vcom (tK)−Vij (tK)=5−5.5=−0.5 [V]<0.

This means that the small electric potential remains even during the data hold period and it works to prevent the black particle from diffusing.

The black particle is kept being drawn to the upper common electrode Com so that the black level of the black display is improved. Consequently, the black contrast is improved and the persistence of the image is eliminated.

5. White Writing After Positively Charged Particle Reset (Period tI)

Following the above-described positively charged particle reset II-(1) and the standby period II-(2), the black writing is performed. In this case, the common electrode bias signal in the writing period tI is denoted as Vcom (tI). Accordingly, the common electrode bias signal is set as Vcom (tI)=Vcom-C. Since the TFT 103 is conductive in this state, the pixel voltage Vij (tI) of the pixel (i, j) in the period tI is set as Vij (tI)=VL.

The electric filed of the electrophoretic element becomes Vcom (tI)−Vij (tI)=Vcom-C−VL>0. Therefore, the screen becomes the white display.

For example, when Vcom (tI)=5 [V] and Vij (tI)=0 [V], Vcom (ti)−Vij (tI)=5−0=5 [V]>0. The white particle is kept being drawn to the upper common electrode Com during this period so that the white level of the white display is improved. Consequently, the white contrast is improved and the persistence of the image is eliminated.

6. Data Hold After White Writing (Period tK)

The common electrode bias signal Vcom (tK) in the data hold period tK is set as Vcom (tK)=Vcom-C Since the TFT 103 is non-conductive in this state, the pixel voltage Vij (tK) becomes as follows:

$$Vij(tK) = Vij(tI) + a \cdot (Vs(tK) - Vs(tI))$$
$$= VL + a \cdot (VSC - VSH) < VL$$

Accordingly, the electric filed of the electrophoretic element becomes Vcom (tK)−Vij (tK)=Vcom-C−VL−α·(VSC−VSH)>Vcom-C−VL>0. Therefore, the screen becomes the white display.

For example, when Vcom (tK)=5 [V], VL=0 [V], VSC=5 [V] and VSL=0 [V], Vcom (tK)−Vij (tK)=5−0+4.5 [V]=+9.5 [V]>0.

The white particle is drawn to the upper common electrode Com so that the screen becomes the strong white display in this period.

Specific Examples

FIGS. 6 through 9 schematically show the states of the electric field between the common electrode and the pixel electrode and the states of the electrophoretic particle in the above described embodiment according to various display conditions. In FIGS. 6 through 9, FIG. A shows a state of a previous screen, FIG. B shows a state of the negatively charged white particle reset, FIG. C shows the standby state, FIG. D shows the writing state and FIG. E shows the data hold state. In the figures, the upper electrode is the common electrode Com and the lower electrode is the pixel electrode. Voltage of each electrode and the voltage values used in the above described embodiments are also shown in the figures. The voltage of the pixel electrode in the pixel (i, j) is denoted as Vij.

FIG. 6 shows the case where the negatively charged particle reset is performed when the pixel of the previous screen is black and the white writing is then carried out. If the negatively charged particle reset is performed when the previous screen is black as shown in FIG. 6A, the screen becomes grayish white. However, the bias voltage is applied in the standby period tW so that the screen gets whiter and becomes stark white (FIG. 6C). Moreover, after the white writing (FIG. 6D), the weak bias voltage is applied during the data hold period tK. This prevents (suppresses) the white particle from diffusing (FIG. 6E). This example corresponds to the case of the pixel (i+1, 1) shown in FIG. 4.

FIG. 7 shows the case where the negatively charged particle reset is performed when the pixel of the previous screen is white and then the black writing is carried out. If the negatively charged particle reset is performed when the previous screen is white as shown in FIG. 7A, the screen becomes white. Since the bias voltage is kept applying during the standby period tW, the screen remains white (FIG. 7C). After this, the black writing is carried out and the screen becomes gray (FIG. 7D). However, a negative bias voltage is applied during the data hold period tK so that the black particle is drawn to the common electrode and the screen gets blacker as time advances (FIG. 7E). Consequently, the gray screen turns to be the black display in the end. This example corresponds to the case of the pixel (i, j) shown in FIG. 4.

Figures 8A, 8B, 8C, 8D, 8E:
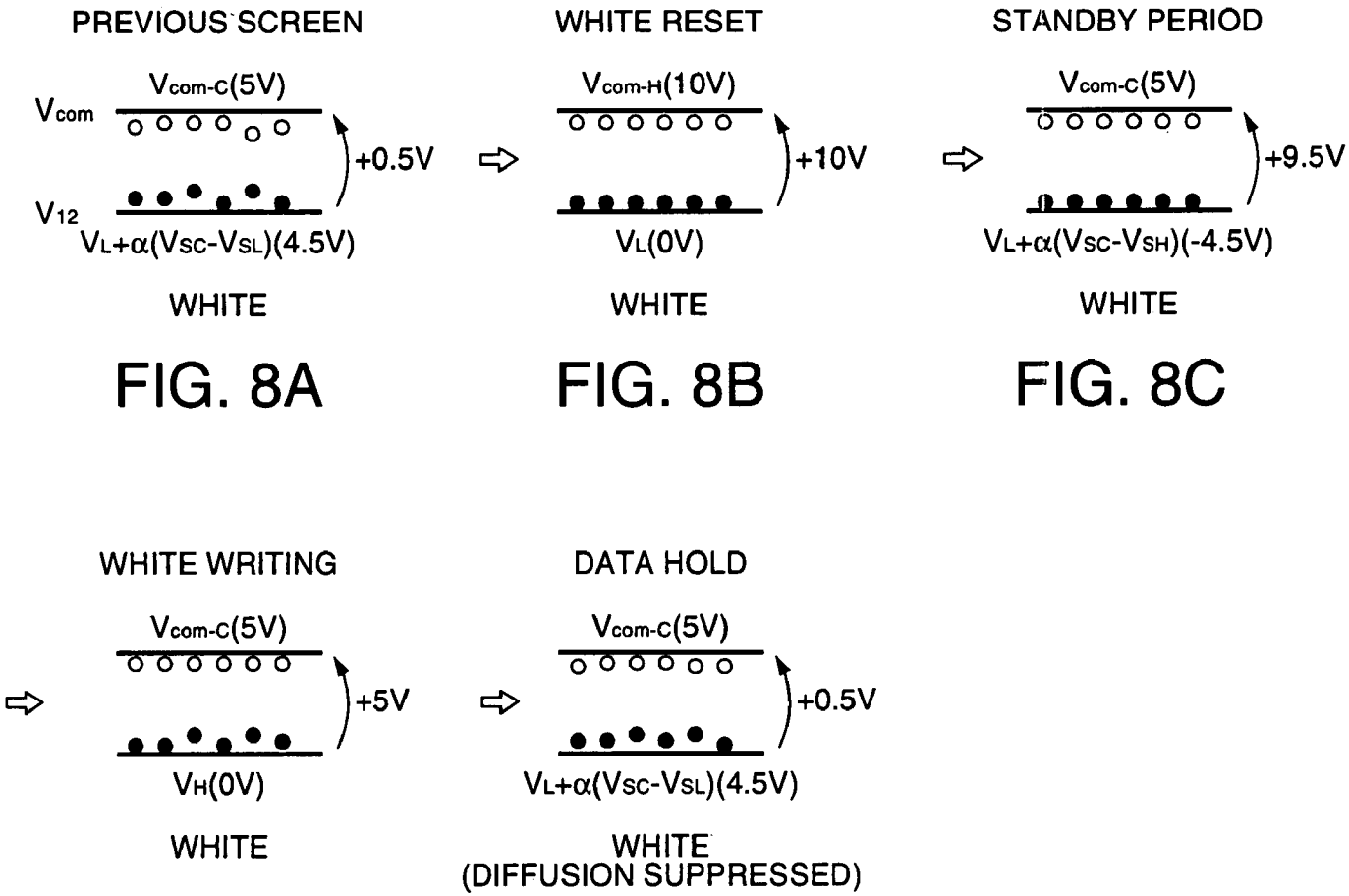
FIG. 8 is an explanatory drawing for white writing (previous screen is white) after the negatively-charged particle reset.
Figure 9A:
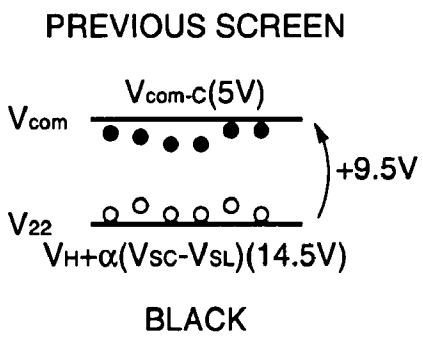
FIG. 9 is an explanatory drawing for white writing (previous screen is black) after the negatively-charged particle reset.
Figure 9B:
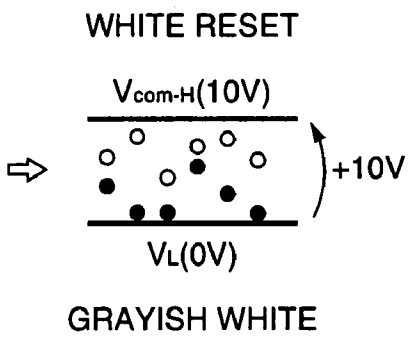
Figure 9C:
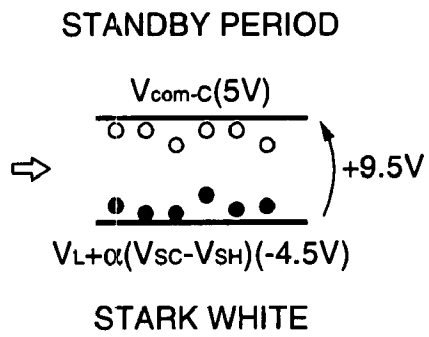
Figure 9D:
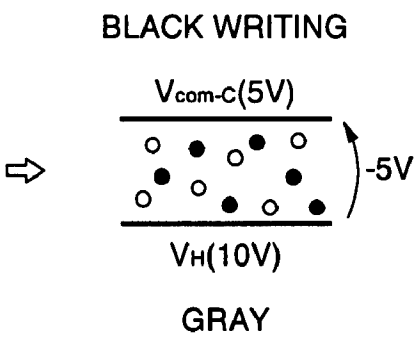
Figure 9E:
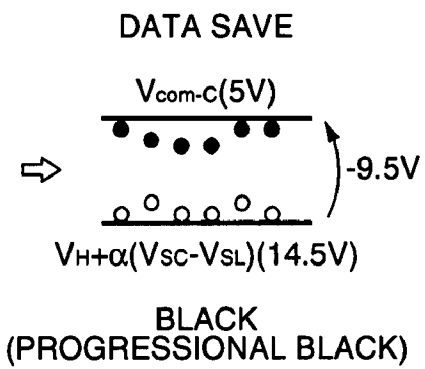

FIG. 8 shows the case where the negatively charged particle reset is performed when the pixel of the previous screen is white and then the white writing is carried out. If the negatively charged particle reset is performed when the previous screen is white as shown in FIG. 8A, the screen remains white. Since the bias voltage is kept applying during the standby period tW, the screen still remains white (FIG. 8C). After this, the white writing is carried out and the screen becomes white (FIG. 8D). However, the weak bias voltage is applied during the data hold period tK and this suppresses the white particle diffusion (FIG. 8E). This example corresponds to the case of the pixel (i, j+1) shown in FIG. 4.

FIG. 9 shows the case where the negatively charged particle reset is performed when the pixel of the previous screen is black and then the black writing is carried out. If the negatively charged particle reset is performed when the previous screen is black as shown in FIG. 9A, the screen becomes grayish white. Since the bias voltage is kept applying even during the standby period tW, the screen gets whiter (FIG. 9C). After this, if the black writing is carried out, the screen becomes gray (FIG. 9D). However, the negative bias voltage is applied during the data hold period tK so that the black particle is drawn to the common electrode and the screen gets blacker as time advances (FIG. 9E). Consequently, the gray state in the black display turns to be the stark black display in the end. This example corresponds to the case of the pixel (i+1, j+1) shown in FIG. 4.

Comparative Examples

FIGS. 10 through 13 show comparative examples of the pixel circuit of the electrophoretic display device in which a second electrode of the storage capacitor is grounded. In the same way as the above described embodiments, the electrophoretic display device has two different kinds of particles. The white particle is negatively charged and the black particle is positively charged.

Figure 10:
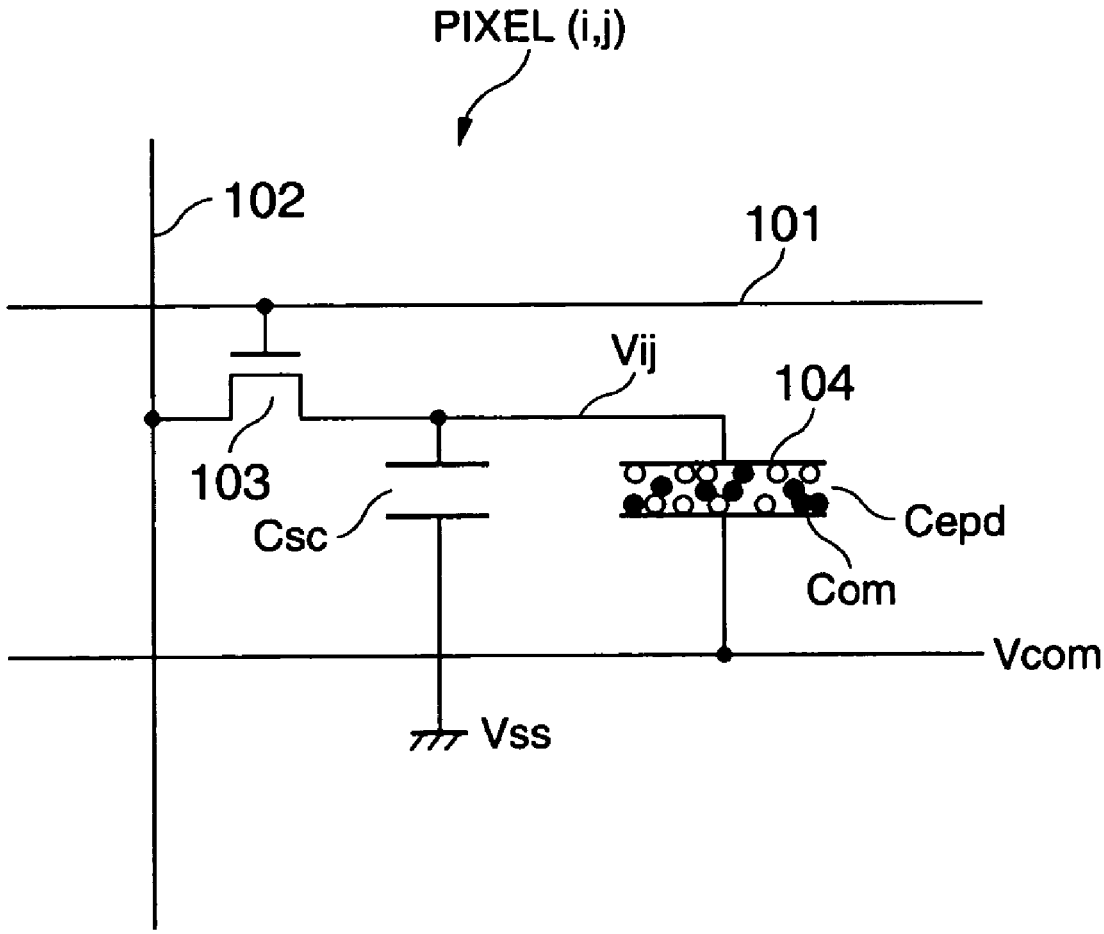
FIG. 10 is a circuit diagram for describing a pixel circuit of a comparative example.

In the comparative example, the storage capacitor Csc in the pixel (i, j) is coupled to a fixed voltage Vss which is, for example, a ground potential, as shown in the pixel circuit diagram of FIG. 10. Other structure and the configuration are same as those in FIG. 2. Therefore, the same reference numerals are given to the corresponding components to those in FIG. 2 and those descriptions are omitted.

Figure 11:
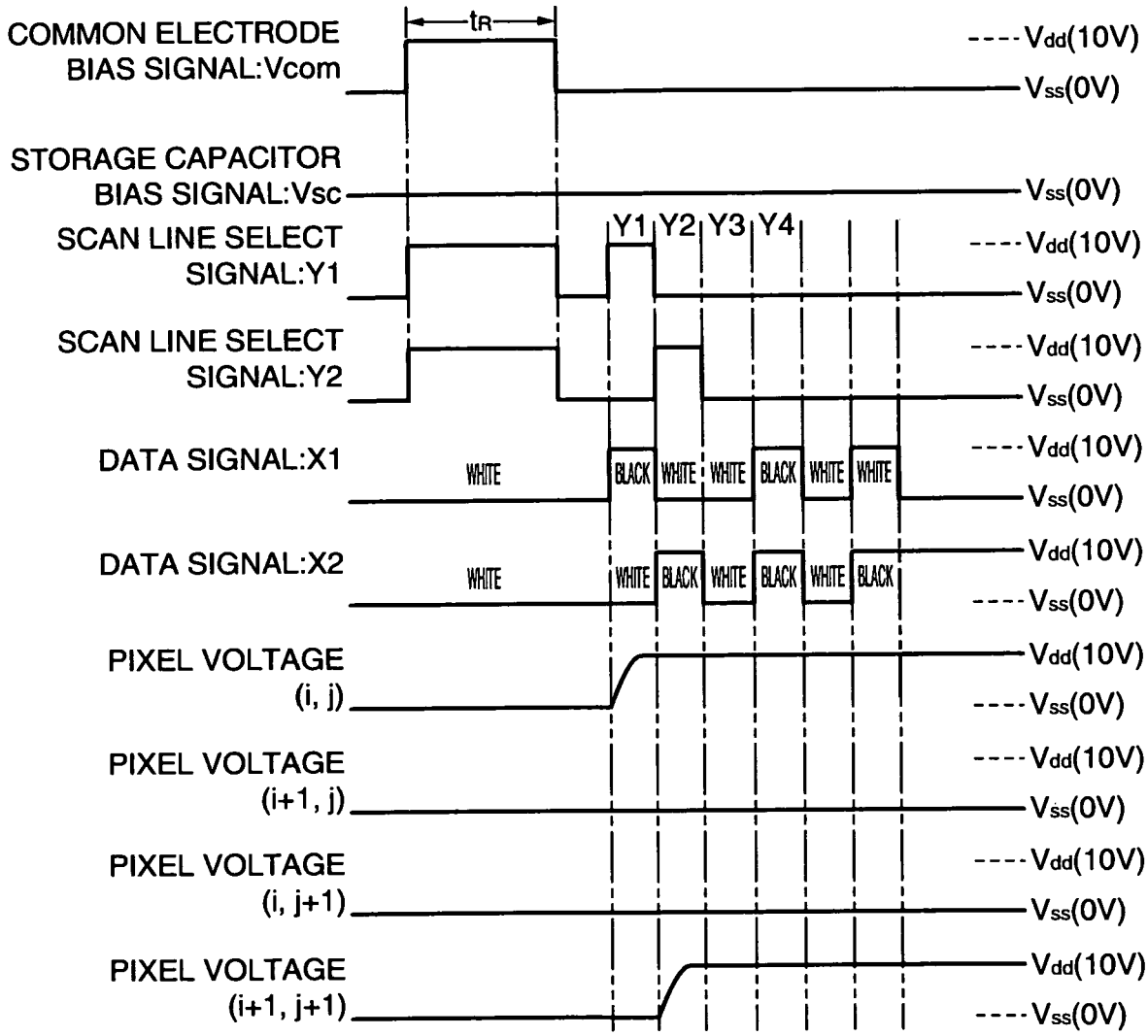
FIG. 11 is a signal timing chart for describing operation of the comparative example.

FIG. 11 is a timing chart of a control signal of the comparative example. The negatively charged particle reset in the pixel is performed by switching the TFT 103 on by setting the voltage Vcom of the common electrode Com to Vdd (10 [V], for example), and setting the pixel electrode voltage Vij to Vss (0 [V], for example). Subsequently, the data writing and the data hold are carried out.

Figures 12A, 12B, 12C, 12D:
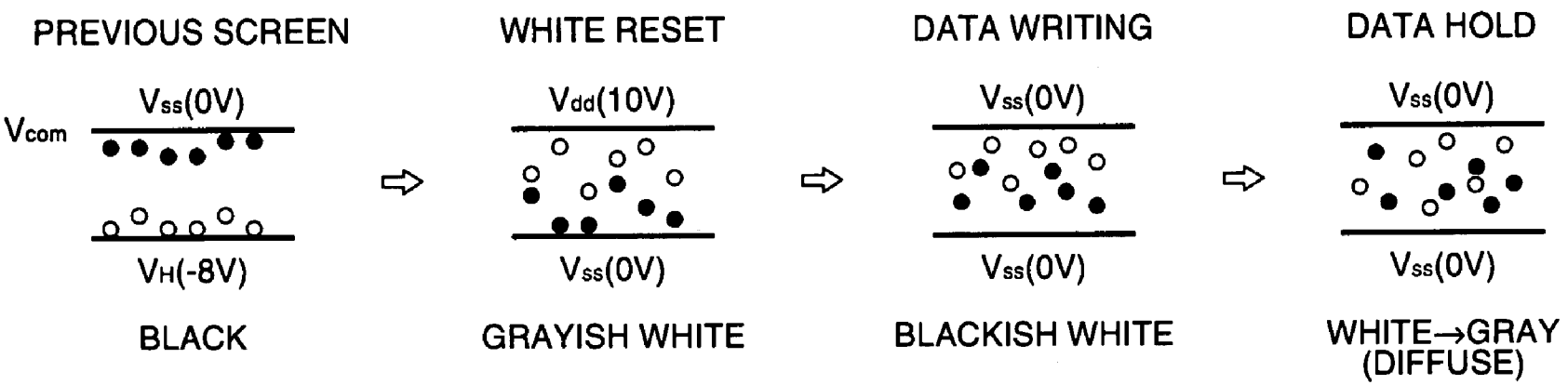
FIG. 12 is an explanatory drawing for white writing (previous screen is black) after the negatively-charged particle reset according to the comparative example.

FIG. 12 shows the operation of the comparative example in the case where the pixel of the previous screen is black and the white writing is performed after the negatively charged particle reset. As shown in FIG. 12A, the previous screen is black and when the negatively charged particle reset is performed, the screen becomes grayish white (FIG. 12B). Next, the white data is supplied and the white writing is conducted. The screen then becomes blackish white (FIG. 12C). During the data hold period, the electrophoretic particle is diffused because the electric potential difference does not exist between the common electrode Com and the pixel electrode, changing the screen from white to gray. This example corresponds to the case of the pixel (i+1, j) shown in FIG. 11.

Figures 13A, 13B, 13C, 13D:
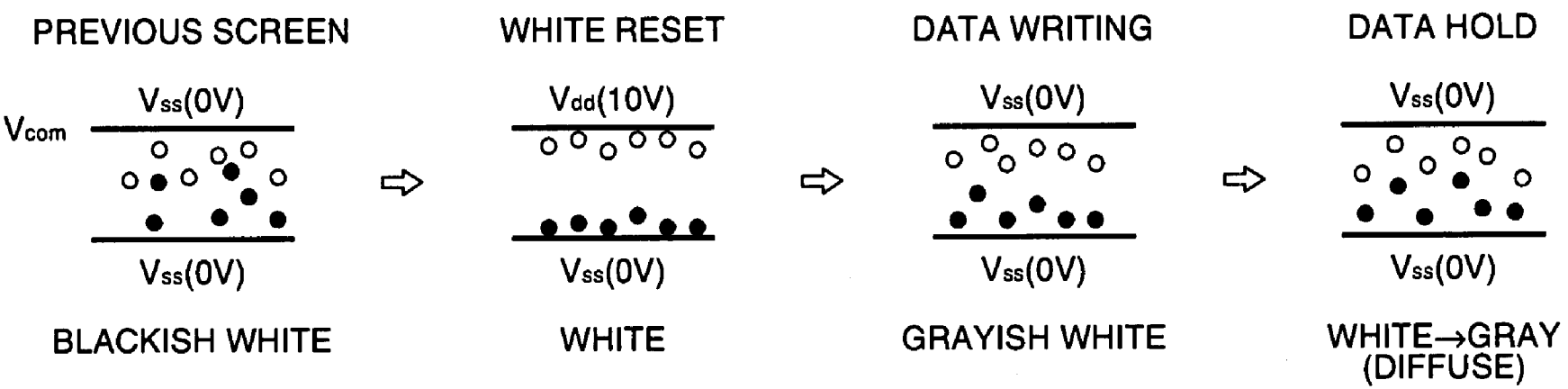
FIG. 13 is an explanatory drawing for white writing (previous screen is white) after the negatively-charged particle reset.

FIG. 13 shows the other operation of the comparative example in the case where the pixel of the previous screen is white and the white writing is performed after the negatively charged particle reset. When the negatively charged particle reset is performed from the state in which the screen is blackish white because of the diffusion as shown in FIG. 13A, the screen becomes white (FIG. 13B). Next, when the white data is supplied and the white writing is conducted, the screen becomes blackish white (FIG. 13C) since the electrophoretic particle is diffused with no potential difference between the common electrode Com and the pixel electrode. During the data hold period, the electrophoretic particle is further diffused because the electric potential difference still does not exist between the common electrode Com and the pixel electrode, making the screen from white to gray. This example corresponds to the case of the pixel (i, j+1) shown in FIG. 11.

According to the comparative examples, the pixel becomes grayish even after the negatively charged particle reset is performed to the black pixel and the afterimage is remained as described above. Furthermore, the electrophoretic particle stats to diffuse after the negatively charged particle reset and the white level becomes gray. Consequently, the contrast is deteriorated.

In contrast to the comparative examples, the bias voltage is applied during the standby period after the negatively charged particle reset according to the embodiment of the invention, and the screen becomes whiter than grayish white. Moreover, it is possible to suppress the electrophoretic particle diffusion.

Furthermore, the electrophoretic particle diffusion after the white writing is prevented by applying the bias voltage during the data hold period after the writing. This also makes the black display rather than the gray display in the black writing.

In this way, it is possible to prevent the contrast deterioration and the persistence of the image according to the embodiment.

Though the above-described embodiment uses the white and black particles as an electrophoretic material and the white particle is negatively charged while the black particle is positively charged, the white particle may be positively charged and the black particle may be negatively charged. In this case, the invention can be applied in the same way by applying the voltage in the opposite direction so as to reverse the polarity of the electric field.

The entire disclosure of Japanese Patent Application No. 2005-079637, filed Mar. 18, 2005 is expressly incorporated by reference herein.

What is claimed is:

1. An electrophoretic display device, comprising:

a first substrate;

a second substrate;

an electrophoretic material interposed between the first substrate and the second substrate, the electrophoretic material including a positively charged particle;

a common electrode provided on the second substrate;

a plurality of signal lines provided on the first substrate;

a plurality of scan lines provided on the first substrate;

a plurality of storage capacitor lines provided so as to correspond to the plurality of scan lines; and a plurality of pixels, each of the plurality of pixels being provided at an intersection of the signal line and the scan line, each of the plurality of pixels including:

a pixel electrode;

a storage capacitor having a first electrode and a second electrode, the second electrode of the storage capacitor being coupled to the storage capacitor line; and a thin film transistor (TFT), a source electrode of the TFT being coupled to a first electrode of the storage capacitor and the pixel electrode, a drain electrode of the TFT being coupled to the signal line, and a gate electrode of the TFT being coupled to the scan line, wherein each of the plurality of storage capacitor lines is driven independently of each other, and is driven independently of the plurality of scan lines, wherein a capacitor line high select signal VSH, a capacitor line non-select signal VSC or a capacitor line low select signal VSL is supplied to each of the plurality of storage capacitor lines, the capacitor line high select signal VSH has a higher electric potential than an electric potential of the capacitor line non-select signal VSC, and the electric potential of the capacitor line non-select signal VSC is higher than an electric potential of the capacitor line low select signal VSL, and wherein a common electrode low level signal Vcom-L or a common electrode central level signal Vcom-C having a higher electric potential than an electric potential of the common electrode low level signal Vcom-L is supplied to the common electrode, wherein the capacitor line low select signal VSL is supplied to the storage capacitor line at the time of a positively charged particle reset in which the positively charged particle is drawn to the second substrate side, and the capacitor line high select signal VSH is supplied to the storage capacitor line during a period in which an image signal is introduced into each pixel.

2. The electrophoretic display device according to claim 1, wherein the common electrode low level signal Vcom-L is supplied to the common electrode at the time of the positively charged particle reset, and the common electrode central level signal Vcom-C is supplied to the common electrode in other cases.

3. The electrophoretic display device according to claim 1, wherein the common electrode low level signal Vcom-L is supplied to the common electrode while the capacitor line low select signal VSL is supplied to the storage capacitor line.

4. The electrophoretic display device according to claim 1, wherein the positively-charged particle reset includes supplying the common electrode low level signal Vcom-L to the common electrode while supplying the capacitor line low select signal VSL to the storage capacitor line.

5. The electrophoretic display device according to claim 1, wherein the common electrode low level signal Vcom-L and the common electrode central level signal Vcom-C are voltages greater than or equal to zero.

6. An electrophoretic display device, comprising:

a first substrate;

a second substrate;

an electrophoretic material interposed between the first substrate and the second substrate, the electrophoretic material including a negatively charged particle;

a common electrode provided on the second substrate;

a plurality of signal lines provided on the first substrate;

a plurality of scan lines provided on the first substrate;

a plurality of storage capacitor lines provided so as to correspond to the plurality of scan lines; and a plurality of pixels, each of the plurality of pixels being provided at an intersection of the signal line and the scan line, each of the plurality of pixels including:

a pixel electrode;

a storage capacitor having a first electrode and a second electrode, the second electrode of the storage capacitor being coupled to the storage capacitor line; and a thin film transistor (TFT), a source electrode of the TFT being coupled to a first electrode of the storage capacitor and the pixel electrode, a drain electrode of the TFT being coupled to the signal line, and a gate electrode of the TFT being coupled to the scan line, wherein each of the plurality of storage capacitor lines is driven independently of each other, and is driven independently of the plurality of scan lines, wherein a capacitor line high select signal VSH, a capacitor line non-select signal VSC or a capacitor line low select signal VSL is supplied to each of the plurality of storage capacitor lines, the capacitor line high select signal VSH has a higher electric potential than an electric potential of the capacitor line non-select signal VSC, and the electric potential of the capacitor line non-select signal VSC is higher than an electric potential of the capacitor line low select signal VSL, and wherein a common electrode low level signal Vcom-L or a common electrode central level signal Vcom-C having a higher electric potential than an electric potential of the common electrode low level signal Vcom-L is supplied to the common electrode, wherein the capacitor line high select signal VSH is supplied to the storage capacitor line at the time of a negatively charged particle reset in which the negatively charged particle is drawn to the second substrate side, and the capacitor line low select signal VSL is supplied to the storage capacitor line during a period in which an image signal is introduced into each pixel.

7. The electrophoretic display device according to claim 6, wherein the common electrode high level signal Vcom-H is supplied to the common electrode at the time of the negatively charged particle reset in which the negatively is performed and the common electrode central level signal Vcom-C is supplied to the common electrode in other cases.

8. The electrophoretic display device according to claim 6, wherein the common electrode high level signal Vcom-H is supplied to the common electrode while the capacitor line high select signal VSH is supplied to the storage capacitor line.

9. The electrophoretic display device according to claim 6, wherein the negatively-charged particle reset operation includes supplying the common electrode high level signal Vcom-H to the common electrode while supplying the capacitor line high select signal VSH to the storage capacitor line.

10. The electrophoretic display device according to claim 6, wherein the common electrode high level signal Vcom-H and the common electrode central level signal Vcom-C are voltages greater than or equal to zero.

11. The electrophoretic display device according to claim 1, further comprising:

a capacitor line driving circuit that supplies one of a plurality of bias signals to each of the storage capacitors via the plurality of storage capacitor lines, wherein the plurality of bias signals include the capacitor line high select signal VSH, the capacitor line non-select signal VSC, and the capacitor line low select signal VSL.

12. The electrophoretic display device according to claim 6, further comprising:

a capacitor line driving circuit that supplies one of a plurality of bias signals to each of the storage capacitors via the plurality of storage capacitor lines, wherein the plurality of bias signals include the capacitor line high select signal VSH, the capacitor line non-select signal VSC, and the capacitor line low select signal VSL.

13. An electrophoretic display device, comprising:

a first substrate;

a second substrate;

an electrophoretic material interposed between the first substrate and the second substrate, the electrophoretic material including a positively charged particle and a negatively charged particle;

a common electrode provided on the second substrate;

a plurality of signal lines provided on the first substrate;

a plurality of scan lines provided on the first substrate;

a plurality of storage capacitor lines provided so as to correspond to the plurality of scan lines;

a plurality of pixels, each of the plurality of pixels being provided at an intersection of the signal line and the scan line, each of the plurality of pixels including:

a pixel electrode;

a storage capacitor having a first electrode and a second electrode, the second electrode of the storage capacitor being coupled to the storage capacitor line; and a thin film transistor (TFT), a source electrode of the TFT being coupled to a first electrode of the storage capacitor and the pixel electrode, a drain electrode of the TFT being coupled to the signal line, and a gate electrode of the TFT being coupled to the scan line; and a capacitor line driving circuit that supplies one of a plurality of bias signals to each of the storage capacitors via the plurality of storage capacitor lines, wherein each of the plurality of storage capacitor lines is driven independently of each other, and is driven independently of the plurality of scan lines, and wherein the plurality of bias signals include a capacitor line high select signal VSH, a capacitor line non-select signal VSC, and a capacitor line low select signal VSL, wherein the capacitor line high select signal VSH has a higher electric potential than an electric potential of the capacitor line non-select signal VSC, and the electric potential of the capacitor line non-select signal VSC is higher than an electric potential of the capacitor line low select signal VSL.

* * * * *